United States Patent [19]

Dressler et al.

[11] 4,068,881

[45] Jan. 17, 1978

[54] ARRANGEMENT FOR AUTOMATIC REGULATION OF THE CABLE LENGTH OF A HOLDING CABLE OF GRAB MEANS

[75] Inventors: Mirko Dressler; Ladislav Dofek, both of Krtiny, Czechoslovakia

[73] Assignee: Vyzkumny ustav lesniho hospodarstvi a myslivosti, Jiloviste-Strnady, Czechoslovakia

[21] Appl. No.: 732,122

[22] Filed: Oct. 13, 1976

[51] Int. Cl.[2] ..... B66C 1/42

[52] U.S. Cl. ..... 294/111; 214/92; 214/147 G

[58] Field of Search ..... 294/111, 112, 88, 118, 294/109; 214/147 G, 130 R, 653, 658, 92; 212/81, 82, 89

[56] References Cited

U.S. PATENT DOCUMENTS

| | | | |
|---|---|---|---|
| 313,880 | 3/1885 | Niblick | 214/92 |
| 3,807,336 | 4/1974 | Briggs | 294/112 |
| 3,860,282 | 1/1975 | Johnson | 294/112 |

*Primary Examiner*—James B. Marbert

*Attorney, Agent, or Firm*—Burgess, Ryan and Wayne

[57] ABSTRACT

Grab means suspended on the end of a jib of traction means, particularly on tractors used for timber skidding are secured in their position by a cable which is automatically tensioned by provided tensioning means.

3 Claims, 2 Drawing Figures

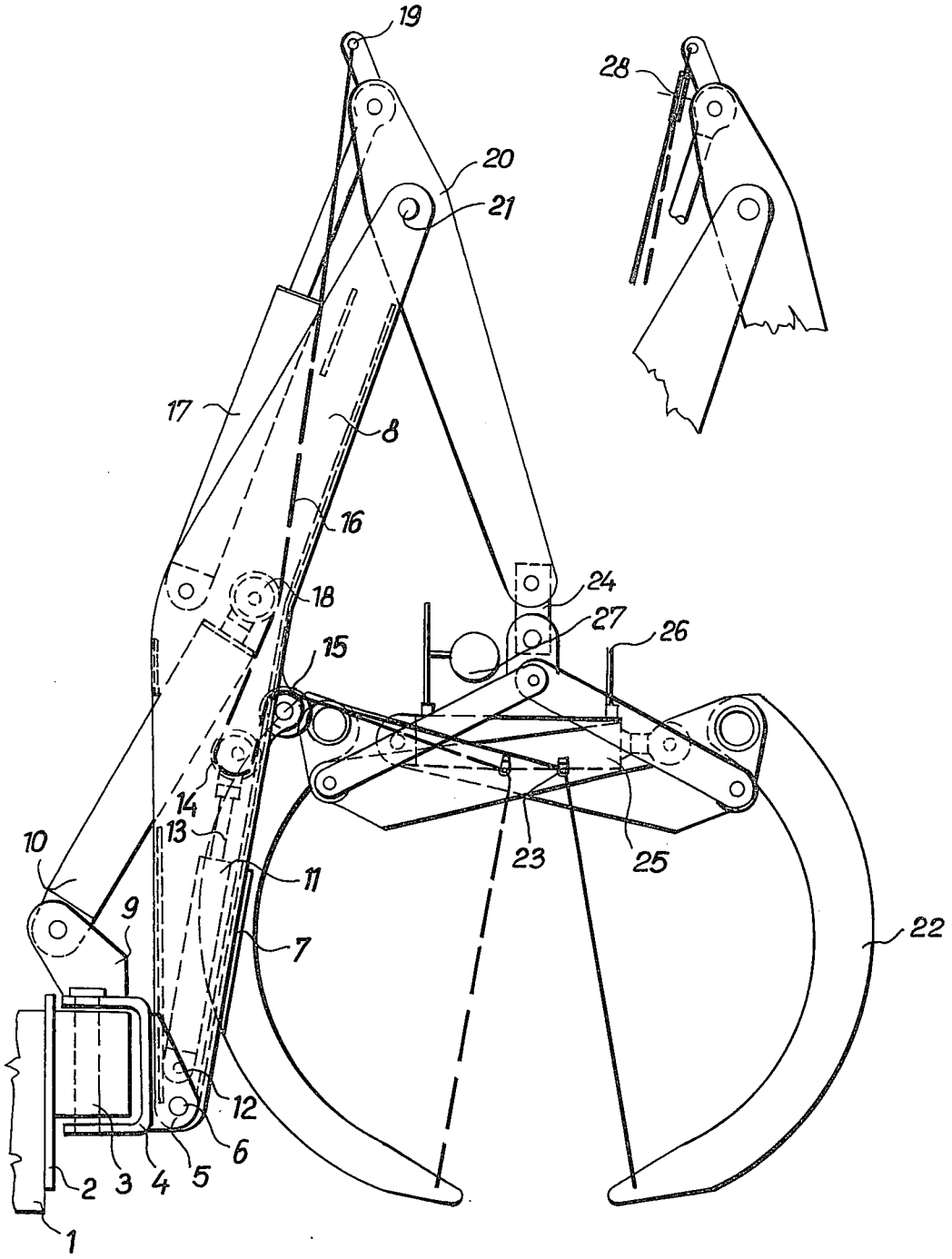
図-2

ARRANGEMENT FOR AUTOMATIC REGULATION OF THE CABLE LENGTH OF A HOLDING CABLE OF GRAB MEANS

BACKGROUND OF THE INVENTION

The invention relates to an arrangement for automatic regulation of the cable length of a cable of grab means used particularly on, but not limited to, tractors used for timber skidding. The tractors have these grab means usually suspended on pivotable arms in order to enable an easier operation with the timber.

A drawback of grabs equipped with arms with more complicated kinematics for the extension of the operating radius is that they do not allow to use securing cables enabling a better grasping of the load and which in the course of drawing the load adjust the action of external forces by bringing the skidding device into a more favourable position. The use of a securing cable brought about difficulties as in case of a shortening of the arm the securing cable became loose and formed sags and in this way made handling inconvenient and requires constant attention.

SUMMARY OF THE INVENTION

It is an object of this invention to provide means which would eliminate this drawback and which would allow the application of a holding cable attached to the grab arms which would automatically maintain its tension for different positions of the grab.

According to this invention one end of the holding cable is fastened to the free end of an auxiliary arm supported in rocking fashion on the end of a jib arm bearing the grab means while the other end of the cable is fixed to the grab means, the cable being led over guiding means and tensioning means on the jib to its suspension on the auxiliary arm. This suspension on the auxiliary arm can be alternatively carried out as an equalizing pulley with twin guiding and tensioning means, the securing rope encompassing this equalizing pulley and its ends fixed to both ends of the grab means. A still better regulation is obtained if the pressure conduits leading to the hydraulic cylinder of the grab means are provided with a pressure storage device.

This arrangement has the advantage over known devices that the load is secured by the cable even if the jib arm or the auxiliary arm are moved. For larger grab means and if the load has to be turned it is advantageous to use a rope fixed with both ends on the ends of grab means, leading the rope over twin guiding and tensioning means to a pulley suspended at the free end of the auxiliary arm. Thus an increased stability is obtained at any position of the jib arm.

DESCRIPTION OF DRAWINGS

An embodiment of this invention is shown in the attached drawings, where

FIG. 2 shows in elevation the arrangement with the jib arm retracted.

DESCRIPTION OF PREFERRED EMBODIMENT

Figure 1:
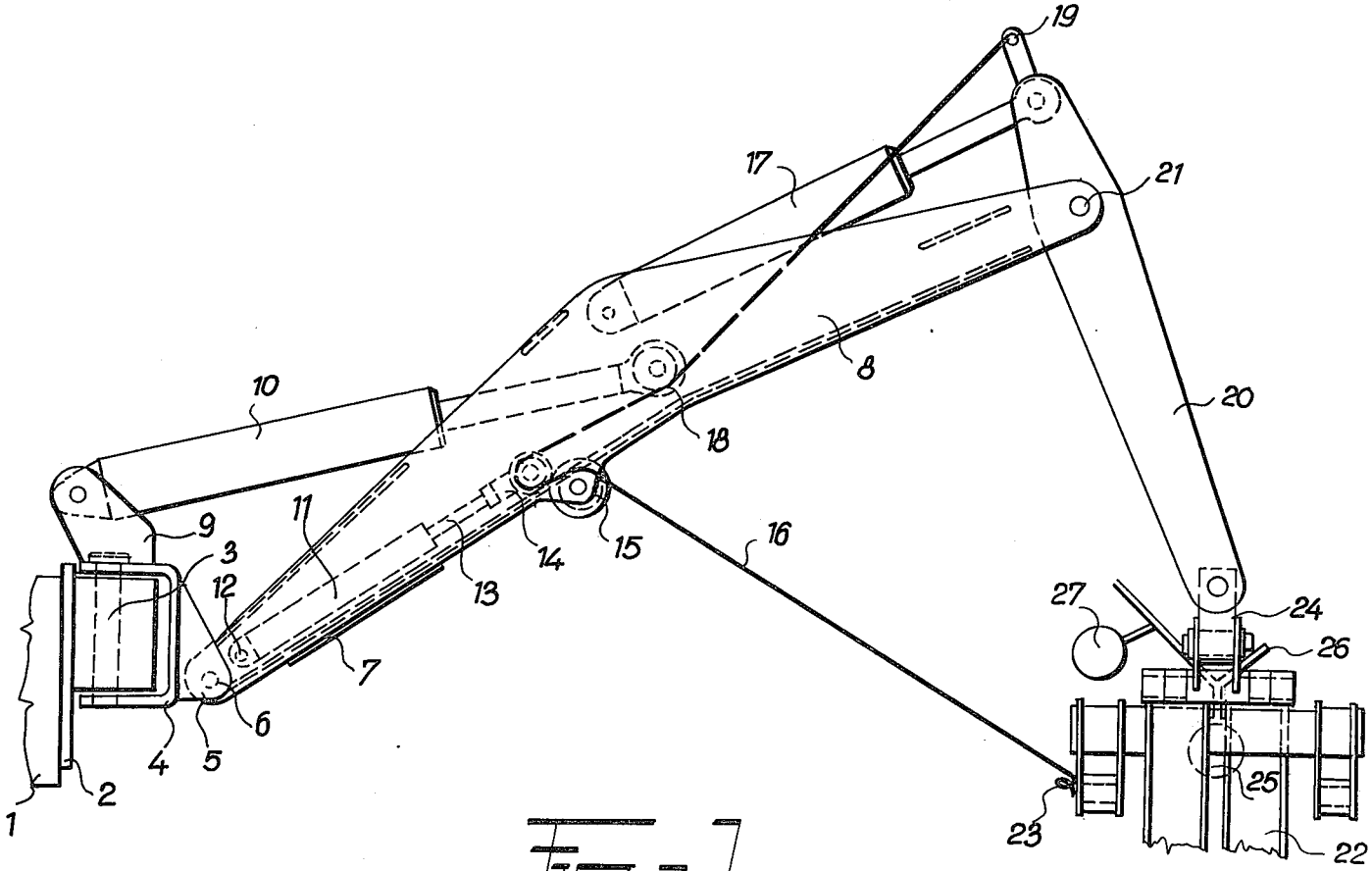
FIG. 1 shows an elevation of an arrangement for automatic regulation of the length of the holding cable of the grab with the jib arm extended.

On the skidding machine, for instance on a tractor 1 a holder 2 is attached. In the holder the body of a turning fork 4 is revolvingly mounted on a bolt 3. On this fork there is the flange 5 of a jib arm. The jib arm 8 is swingingly mounted in the flange 5 on the bolt 6 of the jib arm. The body of the fork 4 is provided with a flange 9, to which the main hydraulic cylinder 10 is joint connected.

At the end of the jib arm 8 an auxiliary arm 20 is swingingly mounted by means of a bolt 21. At one end of the auxiliary arm 20 a cylinder 17 of the auxiliary arm is joint connected. At the second end of the auxiliary arm 20 the suspension 24 of the grab is provided. The grab 22 is equipped with a hydraulic cylinder 25 and with a pressure storage device 27 for compensation of pressure in pressure conduits 26. At the end of the grab 22 is mounted a holding cable 16 led via the guide 23 over a tensioning roller 14 and a guide roller 18 to the suspension 19 of the cable on the free end of the auxiliary arm 20. Both ends of the holding cable 16 may be also fixed on both ends of the grab 22 and guided via twin guides 23 and guide rollers 15, further via a twin tensioning roller 14 to a balance pulley 28 suspended on the auxiliary arm 20 (see FIG. 2).

The tensioning roller 14 is actuated by an actuating device, for instance by a piston rod 13 of a tensioning cylinder 11. The tensioning cylinder 11 is mounted by means of a bolt 12 on the jib arm 8.

The operation of the arrangement for automatic regulation of the length of the holding cable of the grab consists in that the holding cable 16 is in any position of the jib arm 8 and of the auxiliary arm 20 steadily slightly tensioned so that it shows only negligible sagging, notably in the section between the guide roller 15 and the guide device 23. The cylinder 17 of the auxiliary arm controls the position of the auxiliary arm 20 and in this way a change of distances between the tensioning roller 14 and guide devices 23 is accomplished. Due to the connection of the securing cable 16 via the tensioning roller 14 and the guide roller 18 to the suspension 19 of the cable, this part of the cable is stored in the section between the tensioning roller 14 and the suspension 19 of the cable.

The jib arm 8 is tilted by means of the main cylinder 10 attached to the flange 9 of the fork. The body of the fork 4 is turned around the bolt 3 of the fork by means of some not described device, for instance by hydraulic cylinders.

For larger dimensions of the grab, the securing cable 16 is led from both ends of the grab 22 and due to its passage via the double guide 23, guide roller 15, tensioning roller 14, guide roller 18 and an equalizing pulley 28 the load is safety clamped, even if the grab 22 is turned in the suspension 24 of the grab in the vertical direction.

The complete clamping of the load and the securing by the securing cable 16 is accomplished by the tensioning roller 14, for instance by the engagement of the piston rod 13 of the tensioning cylinder 11 which cares for the necessary tension of the securing cable 16. The function of the automatic regulation is more complete if a pressure storage device 27 is provided in the circuit of pressure conduits 26 of the cylinder 25 of the grab. An elastic clamping of the grab 22 and the capability of adjustment for changes of the circumference of the load due to shifting of individual logs in case of skidding timber are thus provided.

We claim:

1. An arrangement for the automatic regulation of the cable length of a securing cable of grab means suspended on one end of an auxiliary arm supported in rocking fashion on one end of an elongated jib arm, which jib arm is anchored on some traction means and adapted to be raised and lowered, said arrangement comprising in combination:

a holding cable, one end of said cable being coupled to the grab means, the other end of said cable being fastened to the other end of the auxiliary arm remote from the end of said auxiliary arm on which said grab means is suspended;

first guiding means for said cable provided on the grab means;

second guiding means for said cable disposed on said jib arm;

a tensioning roller with tensioning means for tensioning said cable disposed on said jib arm;

said holding cable overlying a portion of said tensioning roller;

third guiding means for said cable provided on said jib arm; and means for securing said holding cable to the free end of the auxiliary arm.

2. The arrangement as claimed in claim 1 further comprising an equalizing pulley for suspending the holding cable at said other end of said auxiliary arm, the holding cable overlying a portion of said pulley, said grab means having two ends, and said cable having two parts at the end thereof coupled to the grab means, further including twin guiding and tensioning means for coupling said cable parts to both ends of the grab means.

3. The arrangement as claimed in claim 1, further comprising a hydraulic cylinder for actuating the grab means;

a pressure conduit coupled to said cylinder; and a pressure storage device coupled to said pressure conduit.

* * * * *